US007253564B2

(12) United States Patent
Hsu et al.

(10) Patent No.: US 7,253,564 B2
(45) Date of Patent: Aug. 7, 2007

(54) LAMP CURRENT BALANCING DEVICE

(75) Inventors: Cheng-Chia Hsu, Chupei (TW); Yun-Ching Wu, Hsinchu (TW); Teng-Kang Chang, Jhudong Township, Hsinchu County (TW)

(73) Assignee: Logah Technology Corp., Hsinchu County (TW)

( * ) Notice: Subject to any disclaimer, the term of this patent is extended or adjusted under 35 U.S.C. 154(b) by 111 days.

(21) Appl. No.: 11/233,137

(22) Filed: Sep. 23, 2005

(65) Prior Publication Data

US 2006/0113925 A1 Jun. 1, 2006

(30) Foreign Application Priority Data

Nov. 26, 2004 (TW) ..... 93219001 U

(51) Int. Cl.
*H05B 37/02* (2006.01)

(52) U.S. Cl. ..... 315/224; 315/291; 315/219; 315/255; 315/274; 315/277

(58) Field of Classification Search ..... 315/219, 315/220, 224, 255, 276–279, 274, 282, 291, 315/307, 312, 324, DIG. 4; 363/21.09, 21.1
See application file for complete search history.

(56) References Cited

U.S. PATENT DOCUMENTS 6,114,814 A * 9/2000 Shannon et al. ..... 315/219
7,164,240 B2 * 1/2007 Moyer et al. ..... 315/255
2005/0218827 A1 * 10/2005 Ushijima et al. ..... 315/224
2005/0225261 A1 * 10/2005 Jin ..... 315/255

OTHER PUBLICATIONS

U.S. Appl. No. 11/225,066, filed Sep. 14, 2005, by Hsu.*
U.S. Appl. No. 11/335,655, filed Jan. 20, 2006, by Hsu et al.*

* cited by examiner

*Primary Examiner*—Haissa Philogene
(74) *Attorney, Agent, or Firm*—Rosenberg, Klein & Lee

(57) ABSTRACT

A lamp current balancing device comprises an electronic power switch, a transformer, a current transformer and a pulse width modulation (PWM) IC; the transformer having a primary side connected to the electronic power switch and both ends of a secondary side connected to one end of each one of two lamps respectively, with another end of each one of the two lamps connecting to one end of a primary side of the current transformer respectively, the PWM IC being coupled between a secondary side of the current transformer and the electronic power switch; since the two lamps being cascaded in series with a same current flowing through them, thus providing current balancing capability, furthermore, the current transformer being used to detect an operating current of the lamps and to feed back the operating current to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

5 Claims, 8 Drawing Sheets

LAMP CURRENT BALANCING DEVICE

BACKGROUND OF THE INVENTION

1. Field of the Invention

The present invention relates to a lamp current balancing device, and more particularly, to a lamp current balancing device which is suitable for LCD backlight.

2. Description of the Prior Art

FIG. 1A illustrates an implementation of a prior art control circuit using a single transformer to drive double lamps. The prior art double lamp control circuit comprises a transformer 11 having a primary side connected to a electronic power switch 16 and both ends of a secondary side connected to one end of each one of two lamps 13, 14 respectively, with another end of each one of lamps 13, 14 connecting to PWM IC 15, then PWM IC 15 connecting electronic power switch 16 to form a double lamp control circuit 1; PWM IC 15 receiving and processing a feedback current signal to obtain a control signal, then outputting the control signal to electronic power switch 16 to control a pulse width outputted by electronic power switch 16, thereby controlling the brightness of lamps 13, 14. However, the above-mentioned circuit uses PWM IC 15 to provide feedback function, which cannot effectively balance the operating currents flowing through lamps 13, 14 respectively, resulting in unbalanced brightness between lamps 13, 14 and undermining the capability of lamps.

FIG. 1B illustrates an implementation of a prior art control circuit using double transformers to drive double lamps. The prior art double lamp control circuit uses two transformers 21, 22 simultaneously, each one of transformers 21, 22 having a primary side connected to a electronic power switch 26 and both ends of a secondary side connected to one end of each one of two lamps 23, 24 respectively, with another end of each one of lamps 23, 24 connecting to PWM IC 25, then PWM IC 25 connecting electronic power switch 26 to form a double lamp control circuit 2; PWM IC 25 receiving and processing a feedback current signal to obtain a control signal, then outputting the control signal to electronic power switch 26 to control a pulse width outputted by electronic power switch 16, thereby controlling the brightness of lamps 23, 24. However, the above-mentioned circuit uses PWM IC 25 to provide feedback function, which cannot effectively balance the operating currents flowing through lamps 23, 24, resulting in unbalanced brightness between lamps 13, 14 and undermining the capability of lamps. Furthermore, in the case of controlling multiple lamps, the number of transformers have to be increased proportionally, thus increasing the manufacturing cost.

FIG. 2A illustrates an implementation of a prior art control circuit using a single transformer to drive double lamps and a current transformer to balance brightness among lamps. The prior art double lamp control circuit comprises a transformer 31 having a primary side connected to a electronic power switch 36 and both ends of a secondary side of transformer 31 connected to one end of each one of two lamps 33, 34 respectively, with another end of first lamp 13 connecting to a primary side of a current transformer 37 and another end of second lamp 14 connecting to a secondary side of current transformer 37, then the primary side and the secondary side of current transformer 37 connecting to PWM IC 35, then PWM IC 35 connecting to electronic power switch 36 to form a double lamp control circuit 3. Current transformer 37 is used to control output currents of lamp 33, 34, thereby balancing the output current of lamps 33, 34. PWM IC 35 detects and processes a feedback current signal to obtain a control signal, then outputting the control signal to electronic power switch 36 to control a pulse width outputted by electronic power switch 36, thereby controlling the brightness of lamps 33, 34. Although the above mentioned circuit resolves the problem associated with using PWM IC directly as feedback mechanism, if there are big differences in specifications of lamps, bad coupling problem could arise to cause improper operation, which undermines the capability of lamps.

FIG. 2B illustrates an implementation of a prior art control circuit using double transformers to drive double lamps and a current transformer to balance brightness among lamps. The prior art double lamp control circuit comprises two transformer 41, 42, each one of transformer 41, 42 having a primary side connected to a electronic power switch 46 and both ends of a secondary side of transformer 41, 42 connected to one end of each one of two lamps 43, 44 respectively, with another end of first lamp 43 connecting to a primary side of a current transformer 47 and another end of second lamp 44 connecting to a secondary side of current transformer 47, then the primary side and the secondary side of current transformer 47 connecting to PWM IC 45, then PWM IC 45 connecting to electronic power switch 46 to form a double lamp control circuit 4. Current transformer 47 is used to control output currents of lamp 43, 44, thereby balancing the output current of lamps 43, 44. PWM IC 45 detects and processes a feedback current signal obtain a control signal, then outputting the control signal to electronic power switch 46 to control a pulse width outputted by electronic power switch 46, thereby controlling the brightness of lamps 43, 44. Although the above-mentioned circuit resolves the problem associated with using PWM IC directly as feedback mechanism, if there are big differences in specifications of lamps, bad coupling problem could arise to cause improper operation, which undermines the capability of lamps.

Therefore, the prior art lamp current control device mentioned above presents several shortcomings to be overcome.

In view of the above-described deficiency of prior-art lamp current control device, after years of constant effort in research, the inventor of this invention has consequently developed and proposed a lamp current balancing device in the present invention.

SUMMARY OF THE INVENTION

It is an object of the present invention to provide a lamp current balancing device, which is suitable for controlling double lamps, multiple lamps and maintaining a uniform brightness of the lamps.

It is another object of the present invention to provide a lamp current balancing device, which improves product stability, extends product lifetime, reduces cost and transformer size and saves space for installment.

A lamp current balancing device comprises an electronic power switch, a transformer, a current transformer and a pulse width modulation (PWM) IC; the transformer having a primary side connected to the electronic power switch and both ends of a secondary side connected to one end of each one of two lamps respectively, with another end of each one of the two lamps connecting to one end of a primary side of the current transformer respectively, the PWM IC being coupled between a secondary side of the current transformer and the electronic power switch; since the two lamps being cascaded in series with a same current flowing through them, thus providing current balancing capability, furthermore, the current transformer being used to detect an operating current of the lamps and to feed back the operating current to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
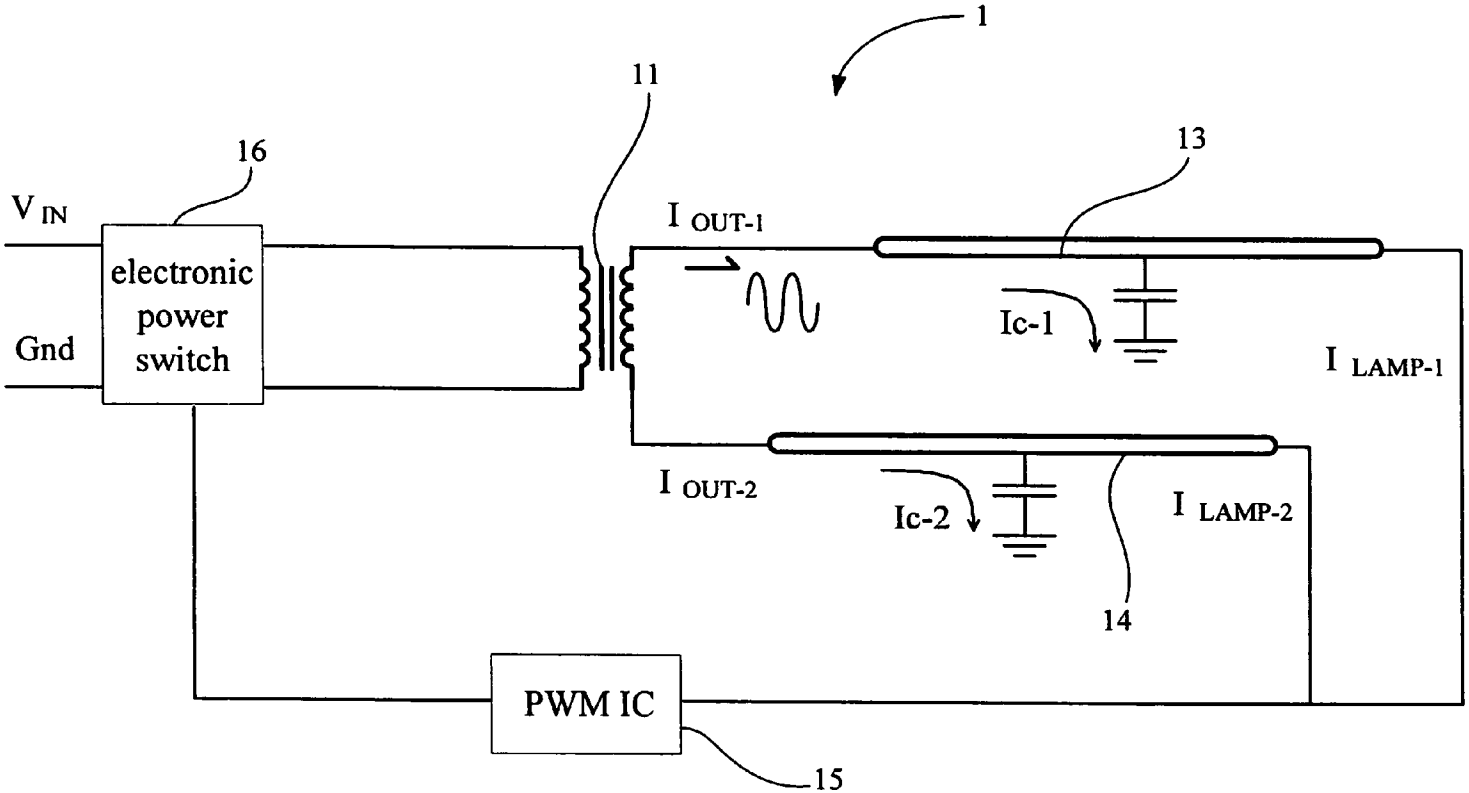
PRIOR ART FIG.1 A
FIG. 1A illustrates an implementation of a prior art control circuit using a single transformer to drive double lamps.
Figure 1B:
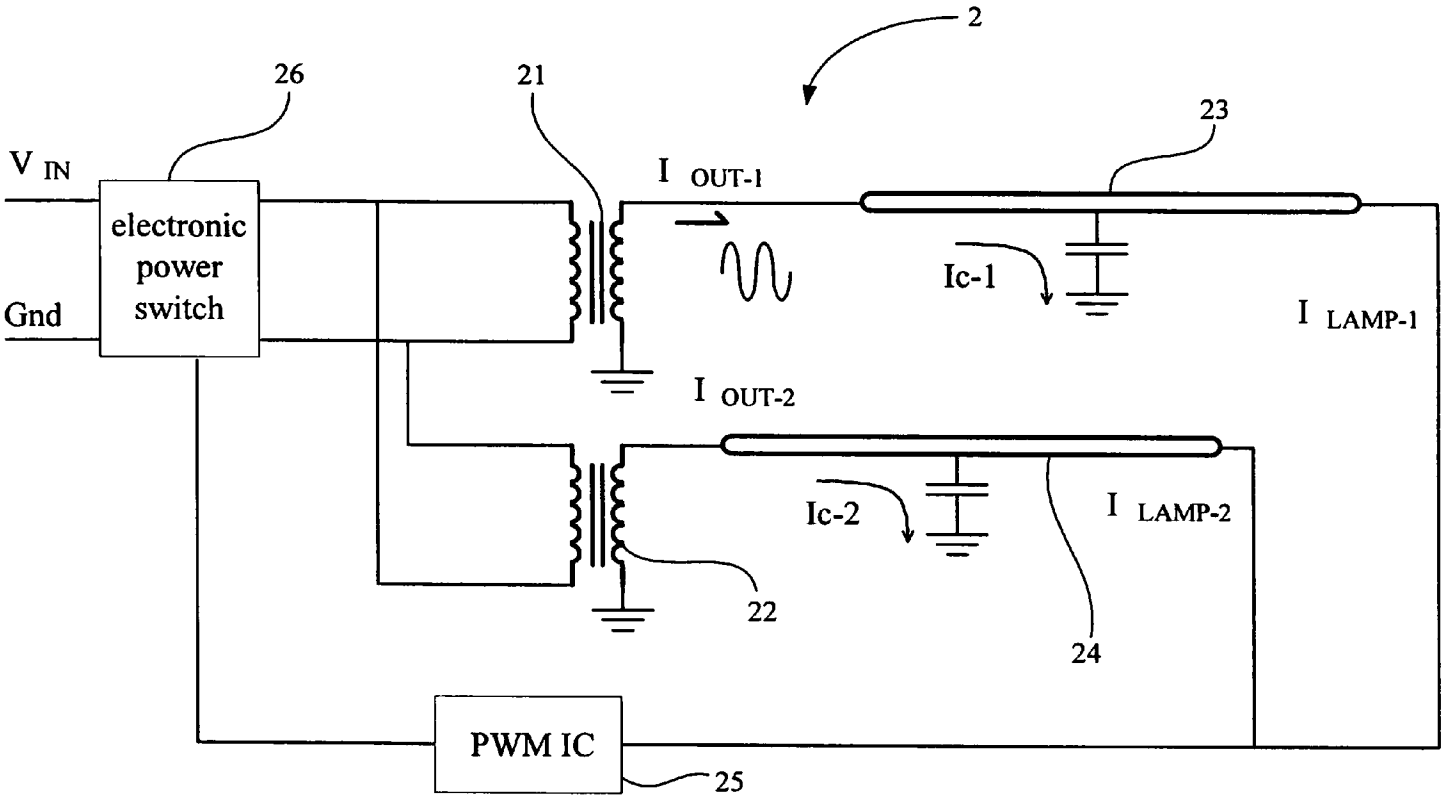
PRIOR ART FIG.1 B
FIG. 1B illustrates an implementation of a prior art control circuit using double transformers to drive double lamps.
Figure 2A:
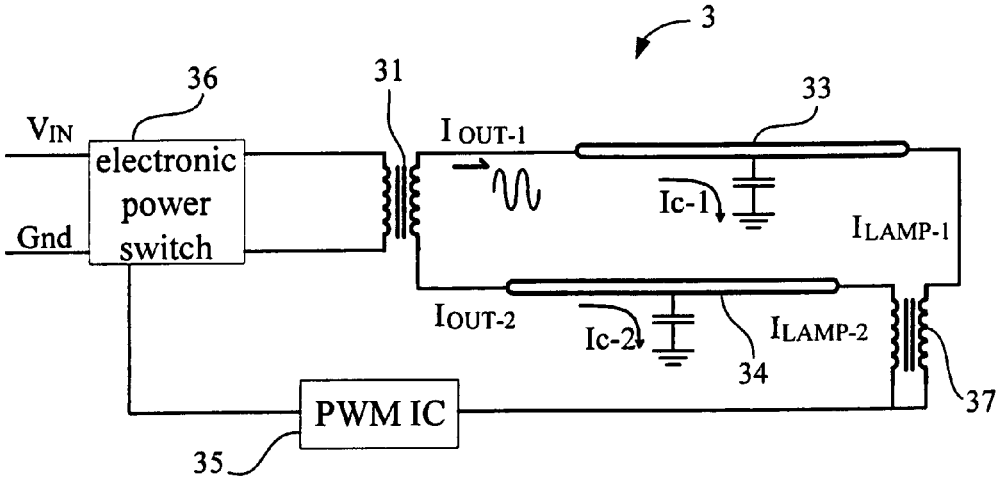
PRIOR ART FIG.2 A
FIG. 2A illustrates an implementation of a prior art control circuit using a single transformer to drive double lamps and a current transformer to balance brightness among lamps.
Figure 2B:
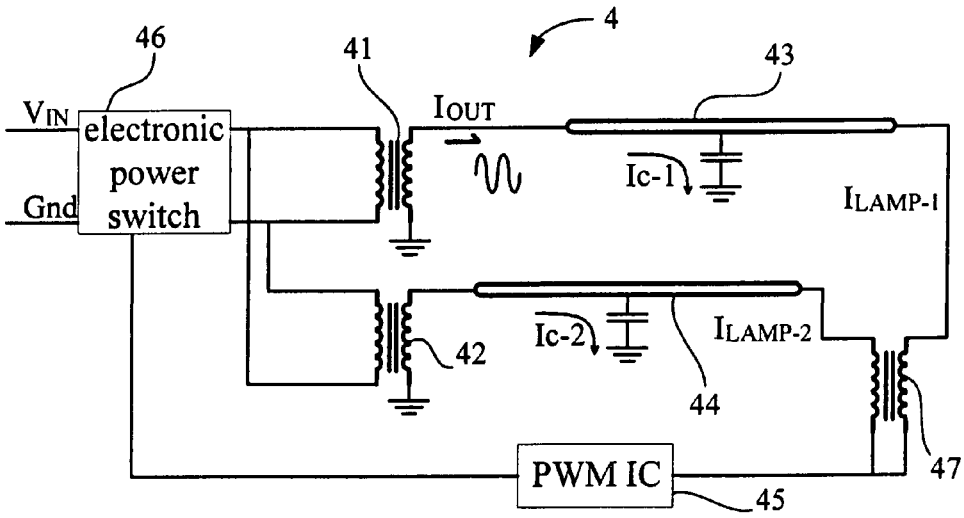
PRIOR ART FIG.2 B
FIG. 2B illustrates an implementation of a prior art control circuit using double transformers to drive double lamps and a current transformer to balance brightness among lamps.
Figure 3A:
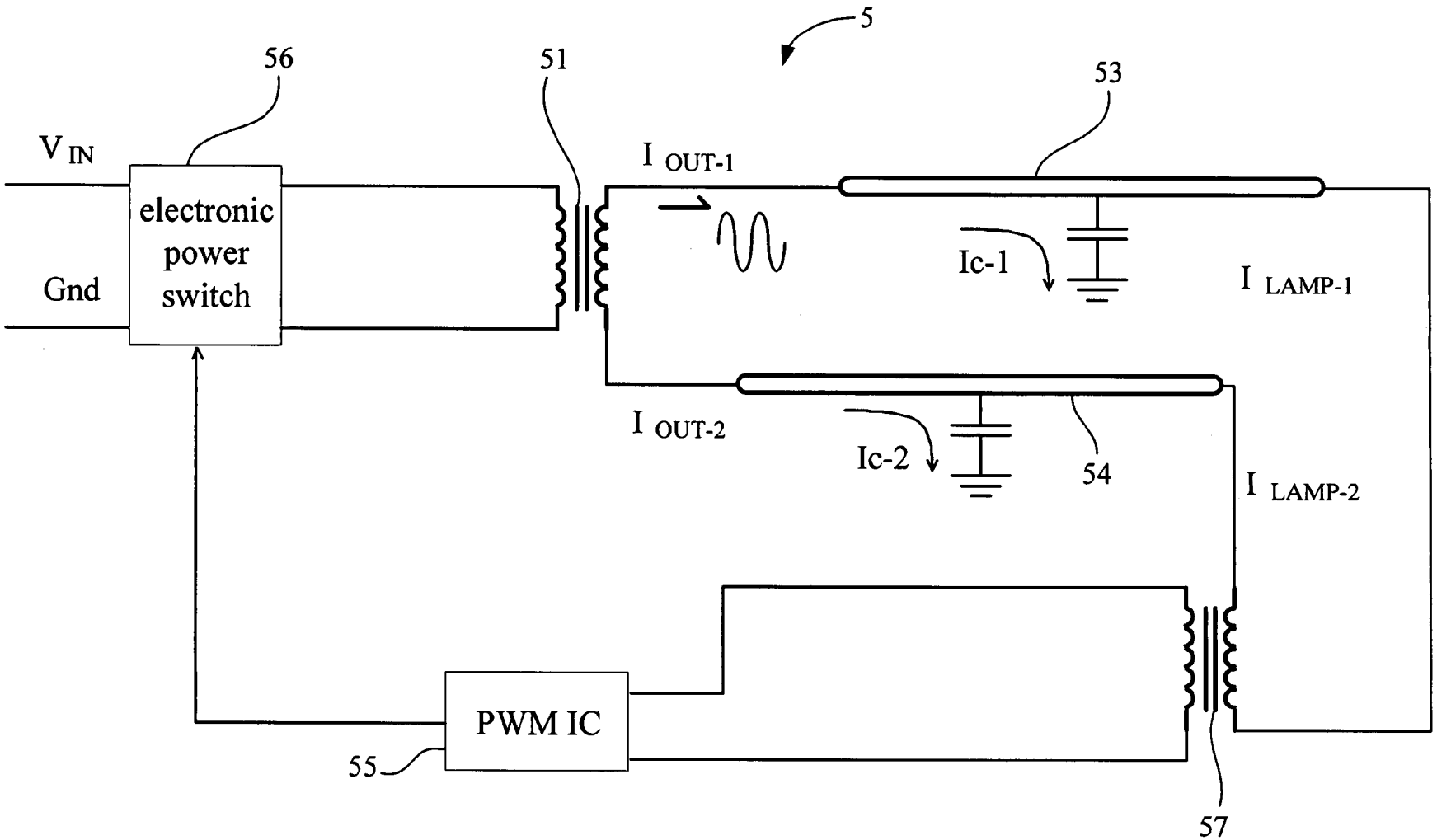
FIG. 3A illustrates an implementation of a lamp current balancing device using a current transformer in the present invention where double lamps are driven by a single transformer.

FIG. 3A illustrates an implementation of a lamp current balancing device using a current transformer in the present invention where double lamps are driven by a single transformer. In this figure, a lamp current balancing device 5 comprises a transformer 51 having a primary side connected to a electronic power switch 56 and both ends of a secondary side connected to one end of each one of two lamps 53, 54 respectively, with another end of each one of lamps 53, 54 connecting to one end of a primary side of current transformer 57 respectively. A PWM IC 55 is coupled between a secondary side of current transformer 57 and electronic power switch 56; since lamps 53, 54 is cascaded in series with a same current flowing through them, thus providing current balancing capability. Furthermore, the current transformer 57 is used to detect an operating current of lamps 53, 54 and to feed back the operating current to PWM IC 55, PWM IC 55 receiving and processing the operating current to obtain a control signal, then outputting the control signal to electronic power switch 56 to control a pulse width outputted by electronic power switch 56, thereby controlling and maintaining a uniform brightness of lamps 53, 54.

Figure 3B:
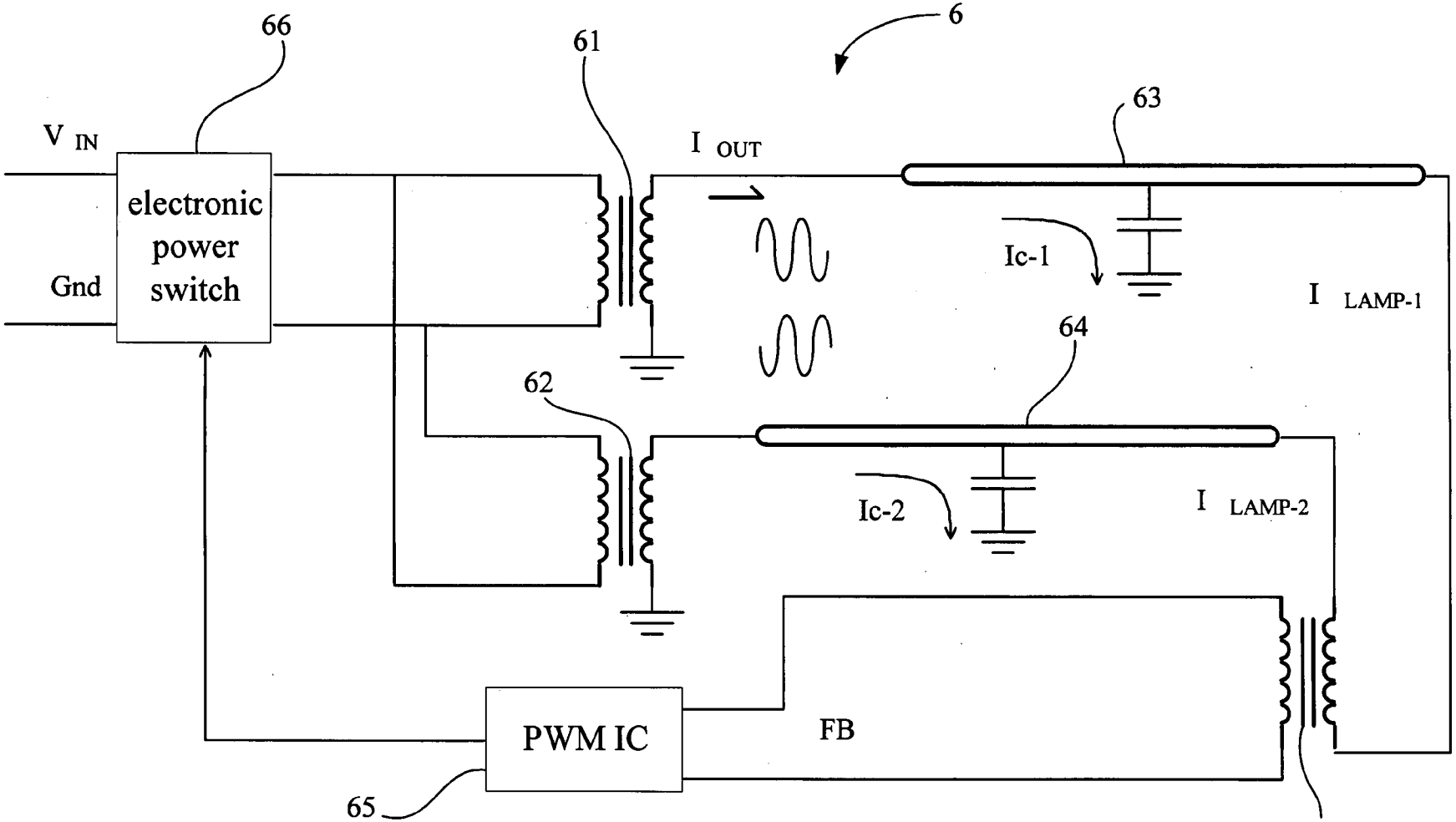
FIG. 3B illustrates an implementation of a lamp current balancing device using a current transformer in the present invention where double lamps are driven by double transformers.

FIG. 3B illustrates an implementation of a lamp current balancing device using a current transformer in the present invention where double lamps are driven by double transformers. In this figure, a lamp current balancing device 6 comprises two transformers 61, 62, each one having a primary side connected to a electronic power switch 66 and both ends of a secondary side connected to one end of each one of two lamps 63, 64 respectively, with another end of each one of lamps 63, 64 connecting to one end of a primary side of current transformer 67 respectively. A PWM IC 65 is coupled between a secondary side of current transformer 67 and electronic power switch 66; since lamps 63, 64 is cascaded in series with a same current flowing through them, thus providing current balancing capability. Furthermore, the current transformer 67 is used to detect an operating current of lamps 63, 64 and to feed back the operating current to PWM IC 65, PWM IC 65 receiving and processing the operating current to obtain a control signal, then outputting the control signal to electronic power switch 66 to control a pulse width outputted by electronic power switch 66, thereby controlling and maintaining a uniform brightness of lamps 63, 64.

Figure 4A:
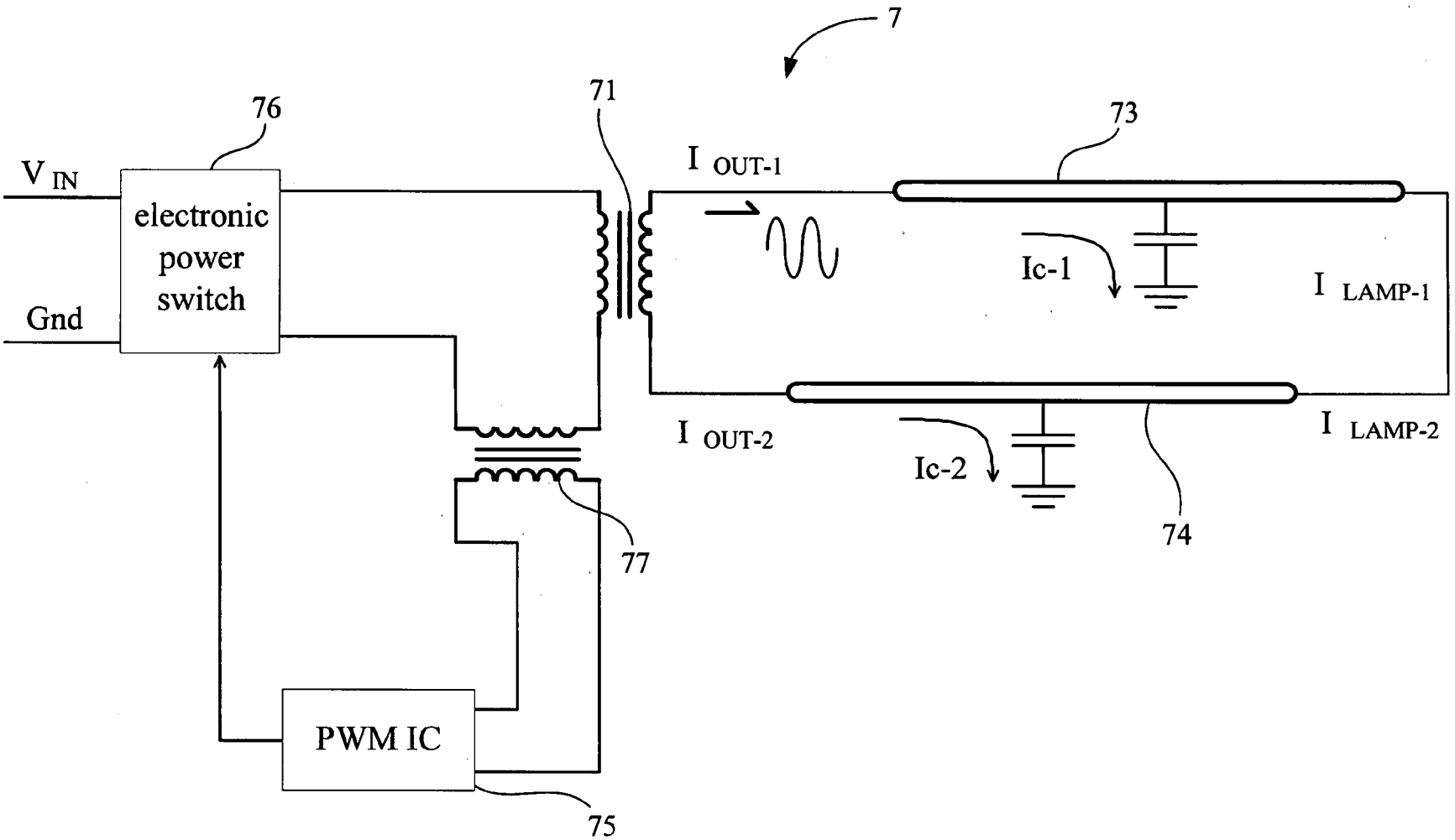
FIG. 4A illustrates another implementation of a lamp current balancing device using a current transformer in the present invention where double lamps are driven by a single transformer.

FIG. 4A illustrates another implementation of a lamp current balancing device using a current transformer in the present invention where double lamps are driven by a single transformer. In this figure, a lamp current balancing device 7 comprises a transformer 71 having a primary side connected to a electronic power switch 76 and both ends of a secondary side cascaded in series with one end of each one of lamps 73, 74 respectively, and the current transformer 77 cascading the primary side of transformer 71 in series. A PWM IC 75 is coupled between a secondary side of current transformer 77 and electronic power switch 76; since lamps 73, 74 is cascaded in series with a same current flowing through them, thus providing current balancing capability. Current transformer 77 feeds back an operating current of the primary side of transformer 71 to PWM IC 75, PWM IC 75 receiving and processing the operating current to obtain a control signal, then outputting the control signal to electronic power switch 76 to control a pulse width outputted by electronic power switch, 76, thereby controlling and maintaining a uniform brightness of lamps 73, 74.

Figure 4B:
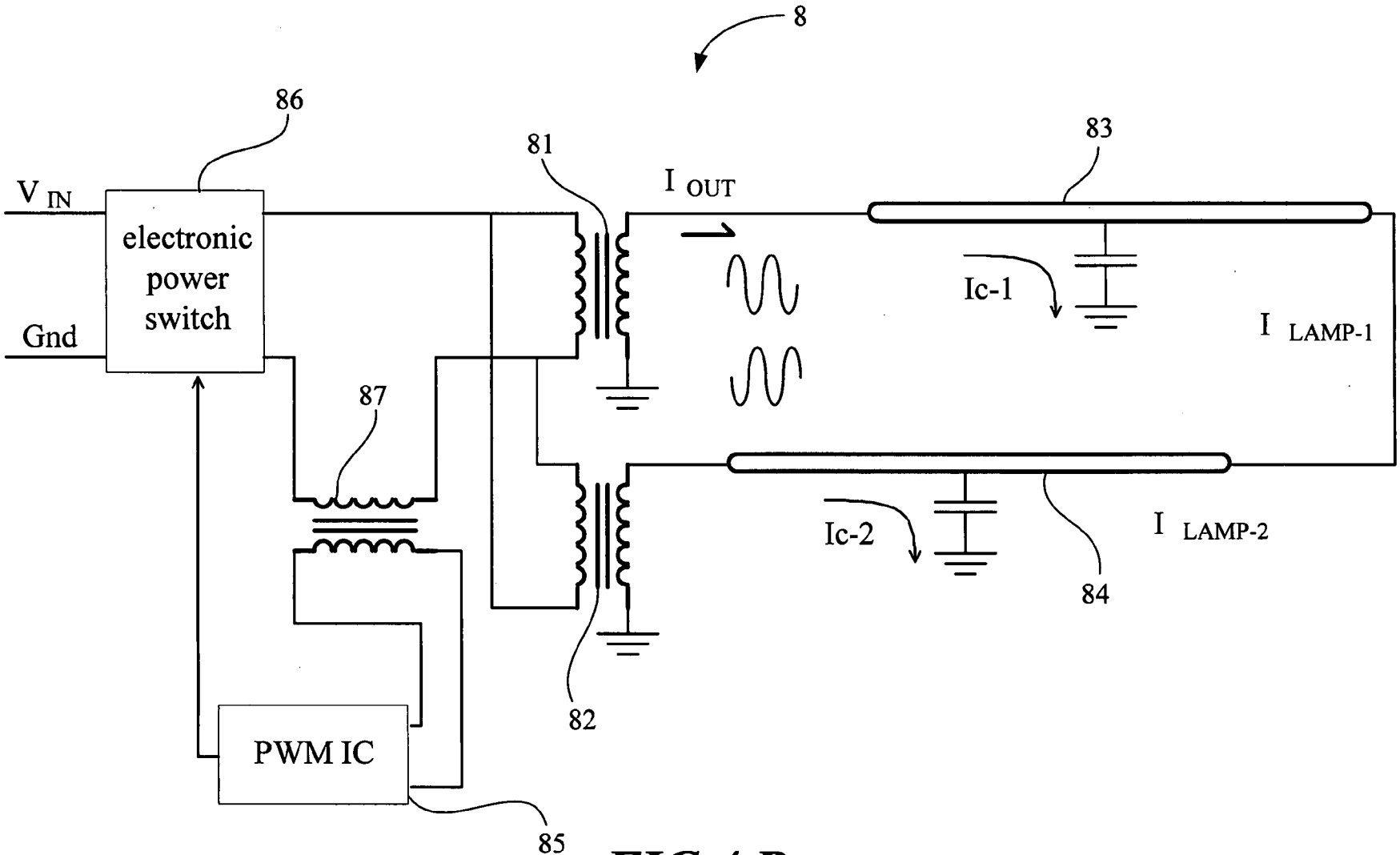
FIG. 4B illustrates another implementation of a lamp current balancing device using a current transformer in the present invention where double lamps are driven by double transformers.

FIG. 4B illustrates another implementation of a lamp current balancing device using a current transformer in the present invention where double lamps are driven by double transformers. In this figure, a lamp current balancing device 8 is suitable for a circuit in which double transformers are used to drive double lamps. Each one of transformers 81, 82 has a primary side connected to a electronic power switch 86 and a secondary side connected to one end of each one of lamps 83, 84 respectively, with another end of each one of lamps 83, 84 connecting to each other and a current transformer 87 cascading the primary side of transformer 81 in series. A PWM IC 85 is coupled between a secondary side of current transformer 87 and electronic power switch 86; since lamps 83, 84 is cascaded in series with a same current flowing through them, thus providing current balancing capability. Current transformer 87 feeds back an operating current from the primary sides of both transformer 81, 82 to PWM IC 85, PWM IC 85 receiving and processing the operating current to obtain a control signal, then outputting the control signal to the electronic power switch 86 to control a pulse width outputted by electronic power switch 86, thereby controlling and maintaining a uniform brightness of lamps 83, 84.

Figure 5:
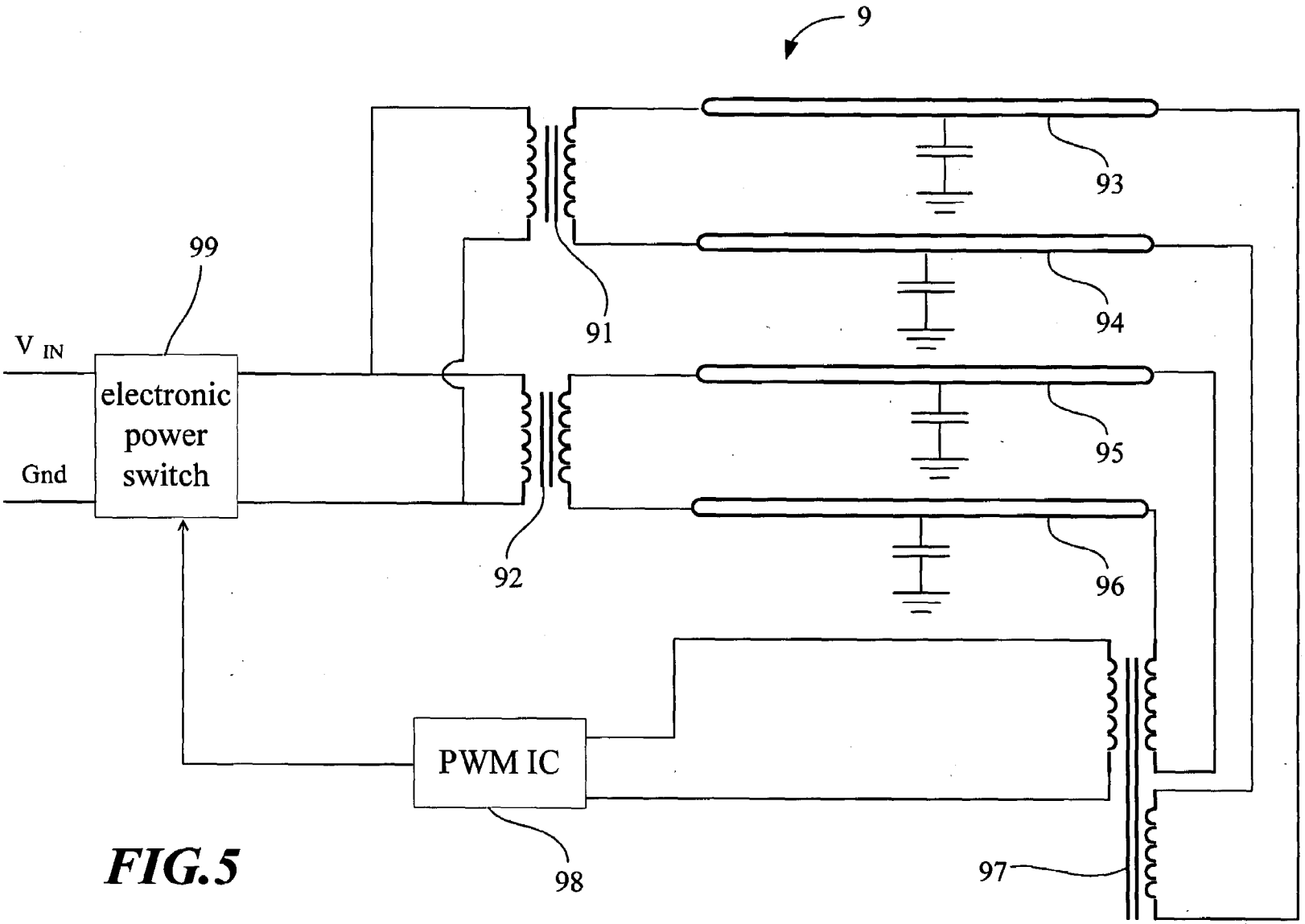
FIG. 5 illustrates an implementation of a lamp current balancing device using a multi-wound current transformer in the present invention where multiple lamps are driven by multiple transformers.

FIG. 5 illustrates an implementation of a lamp current balancing device using a multi-wound current transformer in the present invention where multiple lamps are driven by multiple transformers. In this figure, a lamp current balancing device 9 comprises two transformers 91,92, each having its primary side connected to a electronic power switch 99. Meanwhile, each one of transformers 91, 92 has both ends of its secondary side connected to one end of each one of lamps 93, 94, 95, 96 respectively, and another end of each one of lamps 93, 94, 95, 96 connected to a primary side of a multi-wound current transformer 97. A PWM IC 98 is coupled between a secondary side of current transformer 97 and electronic power switch 99; since lamps 93, 94, 95, 96 is cascaded in series with a same current flowing through them, thus providing current balancing capability. Multi-wound current transformer 97 detects an operating current of lamps 93, 94, 95, 96 and feeds back the operating current to PWM IC 98, PWM IC 98 receiving and processing the operating current to obtain a control signal, then outputting the control signal to the electronic power switch 99 to control a pulse width outputted by electronic power switch 99, thereby controlling and maintaining a uniform brightness of lamps 93, 94, 95, 96.

The present invention provides a lamp current balancing device, which compared with other prior art lamp current control devices, is advantageous in:

The present invention provides a lamp current balancing device, which is suitable for controlling double lamps, multiple lamps and maintaining a uniform brightness of the lamps.

The present invention provides a lamp current balancing device, which improves product stability, extends product lifetime, reduces cost and transformer size and saves space for installment.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lamp current balancing device comprises:

an electronic power switch, a transformer, a current transformer and a pulse width modulation (PWM) IC; the transformer having a primary side connected to the electronic power switch and both ends of a secondary side connected to one end of each one of two lamps respectively, with another end of each one of two lamps connecting to one end of a primary side of the current transformer respectively, the PWM IC being coupled between a secondary side of the current transformer and the electronic power switch;

the current transformer detecting an operating current of the two lamps and feeding back the operating current to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

2. The lamp current balancing device of claim 1, wherein the current transformer is a multi-wound current transformer for working with a plurality of transformers and a multiple number of lamps, thereby controlling and maintaining a uniform brightness of the lamps.

3. A lamp current balancing device comprises an electronic power switch, two transformers, a current transformer and a pulse width modulation (PWM) IC; each one of the two transformers having a primary side connected to the electronic power switch and a secondary side connected to one end of each one of two lamps respectively, with another end of each one of the two lamps connecting to one end of a primary side of the current transformer respectively, the PWM IC being coupled between a secondary side of the current transformer and the electronic power switch; the current transformer detecting an operating current of the two lamps and feeding back the operating current to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

4. A lamp current balancing device comprises an electronic power switch, a transformer, a current transformer and a pulse width modulation (PWM) IC; the transformer having a primary side connected to the electronic power switch and both ends of a secondary side cascaded in series with one end of each one of two lamps respectively, and the current transformer cascading the primary side of the transformer in series, the PWM IC being coupled between a secondary side of the current transformer and the electronic power switch; the current transformer feeding back an operating current of the primary side of the transformer to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

5. A lamp current balancing device comprises an electronic power switch, two transformers, a current transformer and a pulse width modulation (PWM) IC; each one of the two transformers having a primary side connected to the electronic power switch and a secondary side connected to one end of each one of two lamps respectively, with another end of each one of the two lamps connecting to each other and the current transformer cascading the primary side of the transformer in series, the PWM IC being coupled between a secondary side of the current transformer and the electronic power switch; the current transformer feeding back an operating current from the primary side of both transformers to the PWM IC, the PWM IC receiving and processing the operating current to obtain a control signal, then outputting the control signal to the electronic power switch to control a pulse width outputted by the electronic power switch, thereby controlling and maintaining a uniform brightness of the lamps.

* * * * *